United States Patent [19]

Herst

[11] 4,333,209

[45] Jun. 8, 1982

[54] ROTARY POWER SLIPS

[75] Inventor: Neil W. Herst, Houston, Tex.

[73] Assignee: BJ-Hughes Inc., Houston, Tex.

[21] Appl. No.: 165,585

[22] Filed: Jul. 3, 1980

[51] Int. Cl.[3] ..... E21C 1/00

[52] U.S. Cl. ..... 24/263 DA

[58] Field of Search ..... 24/263 DA, 263 D, 263 DH, 24/263 DQ; 173/166, 167

[56] References Cited

U.S. PATENT DOCUMENTS

| | | | |
|---|---|---|---|
| 2,730,331 | 1/1956 | Harinck | 24/263 DA |
| 3,137,348 | 6/1964 | Ahlstone et al. | 24/263 DA |
| 3,571,865 | 3/1971 | Johnson | 24/263 DA |
| 3,579,752 | 5/1971 | Brown | 24/263 DQ |
| 3,748,702 | 7/1973 | Brown | 24/263 DA |
| 3,999,260 | 12/1976 | Stuckey et al. | 24/263 DA |

*Primary Examiner*—Paul J. Hirsch

*Attorney, Agent, or Firm*—Robert A. Felsman; Charles D. Gunter, Jr.

[57] ABSTRACT

Improved rotary power slips having a housing for mounting in a rotary table of an earth drilling rig. Air is transferred from a stationary fluid source on the drilling rig to pneumatic cylinders carried by the housing when said housing is static to operate said slips. Transfer is accomplished by expansion of a perforated annular bladder thereby forming an expansive fluid duct between a stationary seal ring connected to the stationary fluid source and an air transfer plate which is rotatable with the housing.

4 Claims, 12 Drawing Figures

ROTARY POWER SLIPS

BACKGROUND OF THE INVENTION

1. Field of the Invention

This invention relates in general to earth drilling equipment and in particular to rotary power slips mounted concentrically with the pipe opening in a rotary drilling table. It is particularly useful for running drill pipe in and out of a well bore and for running casing pipe into a well bore.

2. Description of the Prior Art

In the past, rotary power slip assemblies utilized slips operated by a fluid cylinder mounted in a stationary position on the rotary table. This arrangement necessitated the use of a mechanical linkage between the fluid cylinder and rotary housing which was subject to fouling and malfunctioning. The slip assembly could not be activated at any point in its rotation but required alignment of the fluid cylinder and rotary housing. The assembly protruded above the rig floor thus consuming valuable space.

In U.S. Pat. No. 3,999,260 to Terry E. Stuckey et al, entitled "Rotary Power Slip Assembly", issued Dec. 28, 1976, rotary power slips are disclosed in which the slips are operated by means of a fluid cylinder carried by the rotary housing. Fluid pressure is first supplied to a stationary seal ring. Expansive seal means on the stationary seal ring form a fluid duct when pressure is applied. Pressure then flows through the inflated duct to the fluid cylinder on the rotary housing to operate the slips. Stuckey's power slips mounted flush with the drill rig floor, eliminated the linkage problems, and could be operated at any point in their rotation. In spite of these advantages, Stuckey's power slips required a cumbersome mounting structure underneath the rotary table to support the stationary seal ring. The expansive seal means deteriorated rapidly due to rig vibration affecting alignment of the seal means and rotary housing. Mud and debris also collected on the surface of the expansive seal.

SUMMARY OF THE INVENTION

It is therefore an object of this invention to provide improved rotary power slips which eliminate the need for a special mounting structure underneath the rotary table, which occupy less space, and which have a longer wearing expansive seal.

It is another object of this invention to provide rotary power slips which give quicker response to the slips and which are more effectively sealed against the accumulation of mud and debris.

The improved rotary power slips of this invention are operable from a stationary fluid source and valve means located on the drilling rig and have a housing for mounting concentrically with the pipe opening in the rotary table. An annular stationary seal ring having a transverse upper surface is supported by the housing generally coaxially with the pipe opening in the rotary table. The stationary seal ring is provided with a primary fluid conduit for connection to the stationary fluid source on the drilling rig. An annular air transfer plate having a transverse lower surface is secured to the housing adjacent to the stationary seal ring. Expansive means are mounted on the upper surface of the stationary seal ring and cooperate with the lower transverse surface of the air transfer plate to form at least one annular expansive fluid duct therewith when pressure is applied to the primary fluid conduit. The housing has a secondary fluid conduit in fluid communication with the annular fluid duct.

Fluid actuated operator means are connected to the slips and are carried by the housing in fluid connection with the secondary fluid conduit. The fluid actuated operator means selectively grip and release pipe in the rotary table in response to fluid flow through the primary conduct, the annular expansive fluid duct, the air transfer plate, and the secondary fluid conduit.

Preferably, the operator means is a double acting pneumatic cylinder. In certain embodiments, it is desirable to have inner and outer downwardly facing annular recesses on the lower transverse surface of the air transfer plate. These recesses form inner and outer fluid ducts with the expansive means mounted on the upper surface of the stationary seal ring. The expansive means is preferably an annular bladder having perforations therein for the flow of fluid. The pneumatic cylinder is connected to the slips and is in fluid communication at one end to the inner fluid duct and at the opposite end to the outer fluid duct. The slips are moved between an extended position to release pipe and a retracted position to grip pipe in response to fluid flow through the perforations.

DETAILED DESCRIPTION OF THE INVENTION

Figure 1:
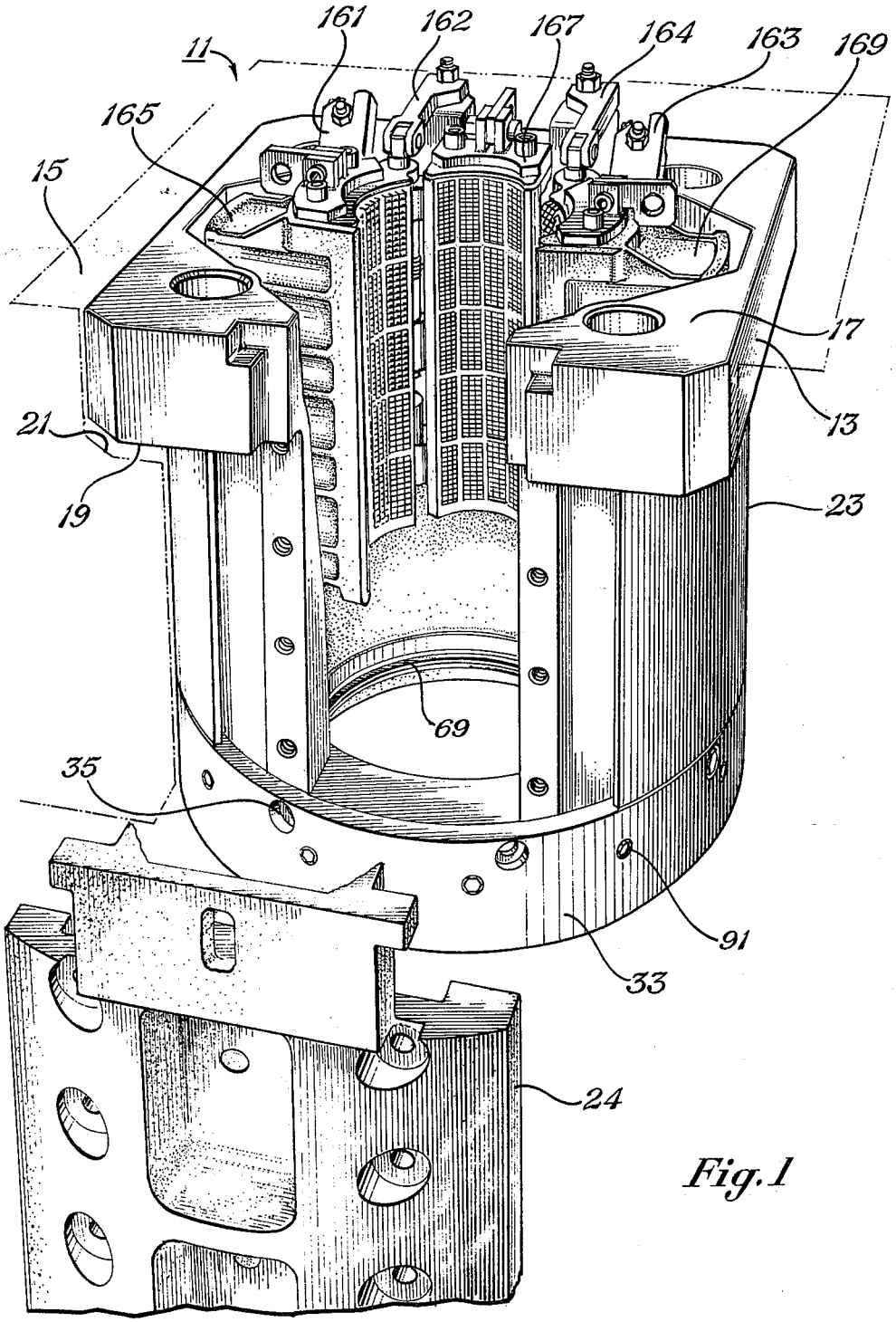
FIG. 1 is a perspective view of the improved rotary power slips of this invention.

Referring to FIG. 1, the improved rotary power slips are generally designated by the numeral 11. Rotary power slips 11 include a housing 13 provided with an external configuration comparable to a standard master bushing and arranged for support in rotary table 15 in the same manner. Upon rotation of the rotary table 15, housing 13 will be caused to be rotated while being supported in rotary table 15. Housing 13 has a generally square upper end 17 with a shoulder 19 which engages a complimentary shoulder 21 in the opening in rotary table 15, and a cylindrically shaped lower end 23. A removable door 24 attaches to lower end 23 as by bolts.

Figure 2:
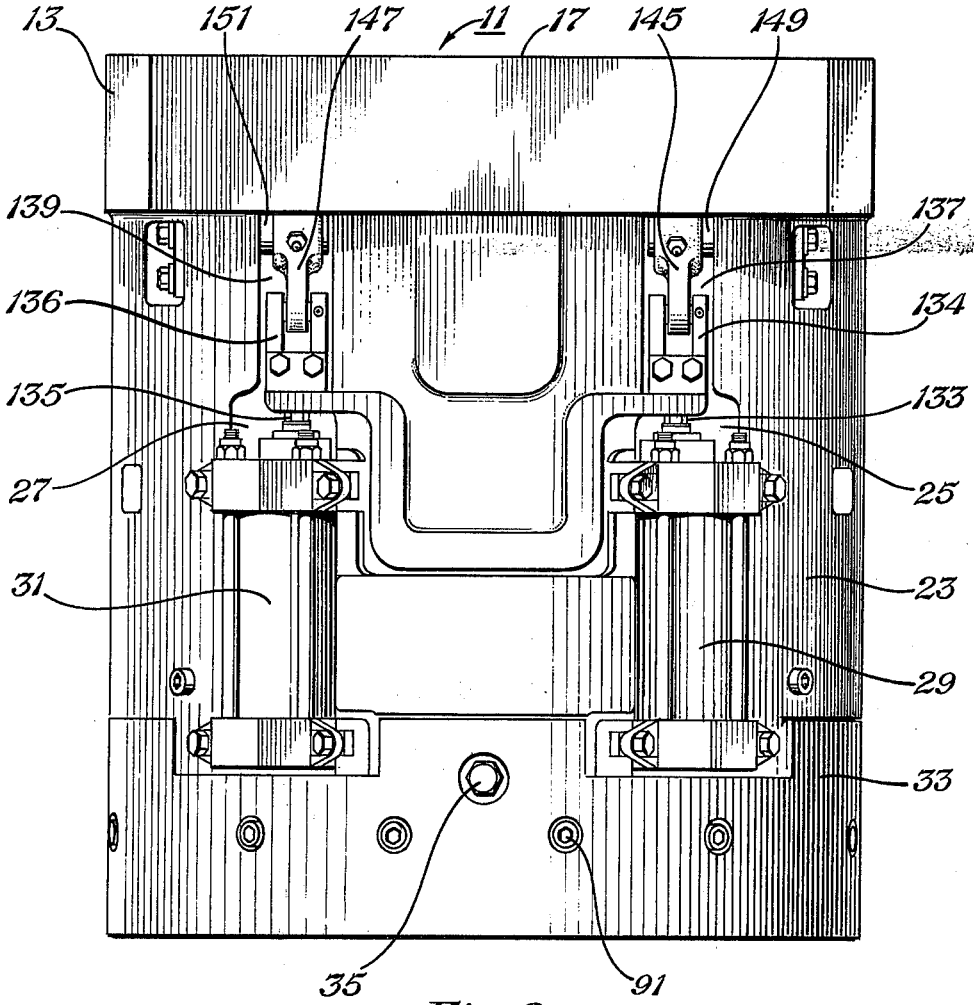
FIG. 2 is a side view of the rotary power slips showing the fluid cylinders.

Lower end 23 has circumferential recesses 25, 27 in which are mounted double acting pneumatic cylinders 29, 31 as shown in FIG. 2. For purposes of convenience, cylinders 29, 31 and certain elements associated therewith may sometimes be referred to as fluid actuated operator means.

An annular bearing support ring 33 is secured to the lower end 23 of housing 13 for rotation therewith as by bolts 35. A bearing comprising lower race 37, upper race 39, and a plurality of balls 41 is carried by the bearing support ring 33 in a slot 43 (see FIGS. 3, 4). The actual load of slips 11 is carried by the rotary table 15. The bearing upper race 39, lower race 37 and ball 41 serve as a rotary guide with some side loading.

Stationary seal ring 45, shown in FIG.'s 3, 4, 6, 7 and 11, has a bottom surface 47, top surface 49 and peripheral flange 51, said flange 51 being supported by upper bearing race 39. Seal ring 45 has an annular opening 53 which is generally coaxial with the pipe opening in the rotary table 15. Bottom surface 47 and top surface 49 are transverse to an axis drawn through the center of the pipe opening in the rotary table 15 and are preferably perpendicular thereto.

Figure 5:
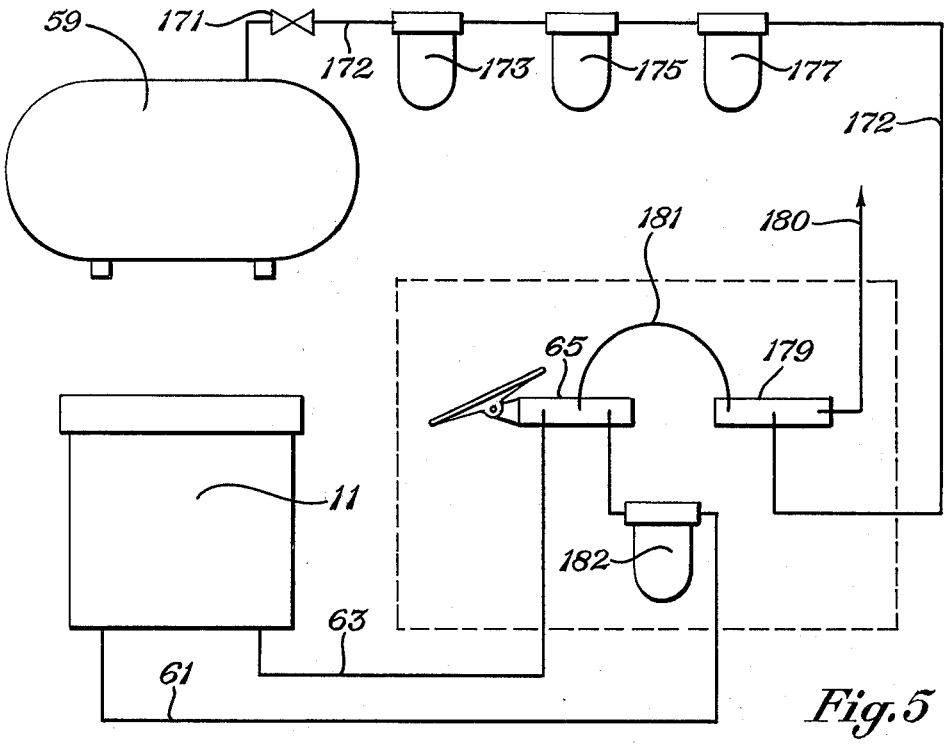
FIG. 5 is a schematic diagram of the pneumatic control mechanism.
Figure 6:
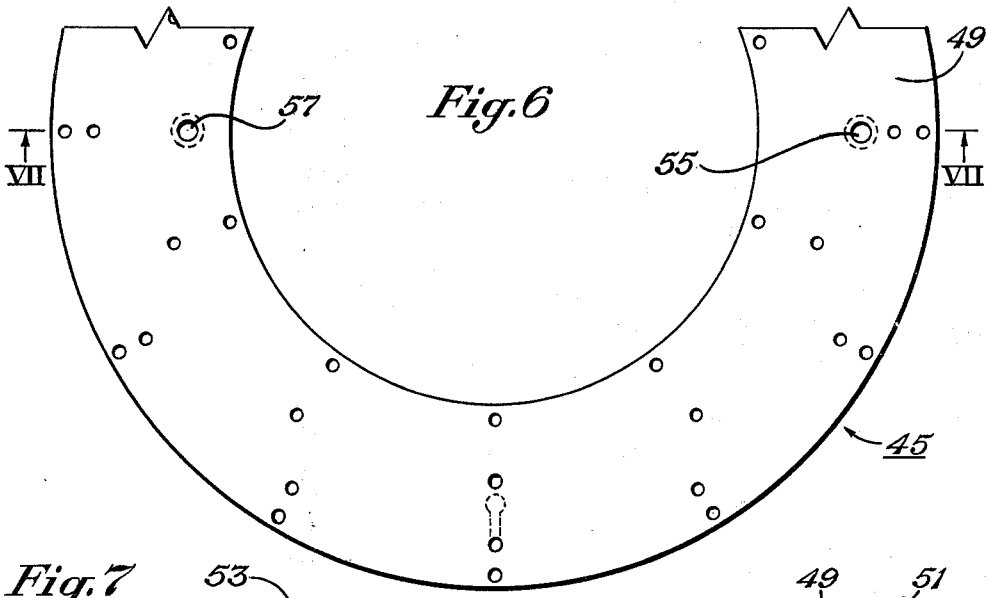
FIG. 6 is a top view of the stationary seal ring.
Figure 7:
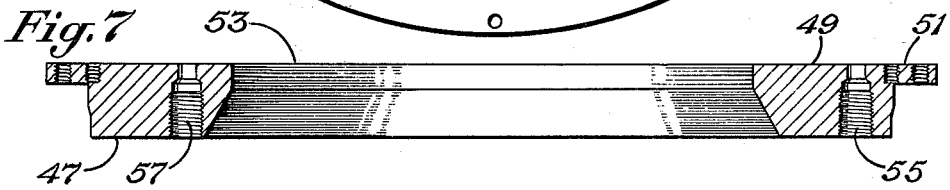
FIG. 7 is a sectional view taken generally along lines VII—VII of FIG. 6.
Figure 8:
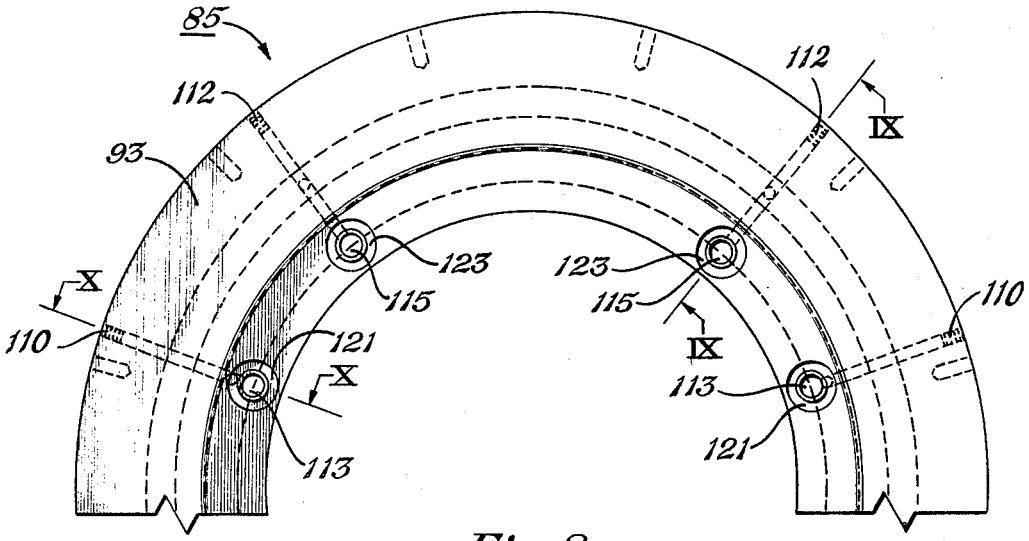
FIG. 8 is a top view of the air transfer plate.

Seal ring 45 has primary fluid conduits 55, 57 which pass between bottom surface 47 and top surface 49. Said primary fluid conduits 55, 57 are connected to a stationary fluid source 59 on the drilling rig by lines 61, 63. A valve means including foot pedal 65, shown schematically in FIG. 5, controls flow of fluid pressure from the stationary fluid source 59 through lines 61, 63.

Figure 4:
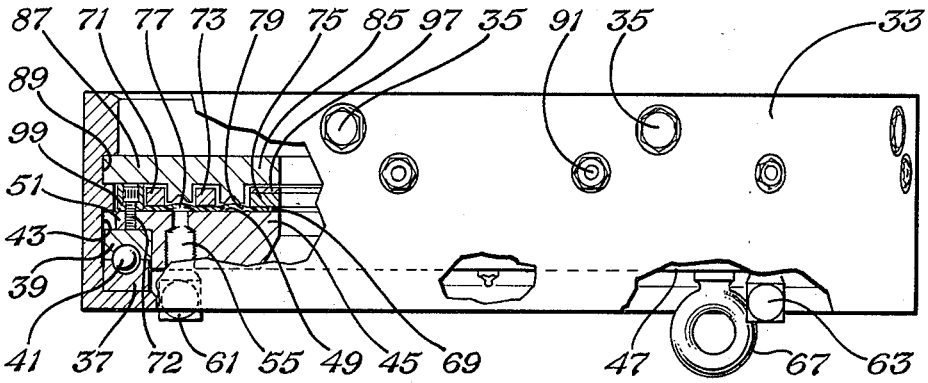
FIG. 4 is a side view of the bearing support ring with portions broken away.

Eye bolt 67, seen in FIG. 4, extends from the bottom surface 47 of seal ring 45 for connection to a cable on the drilling rig.

Figure 3:
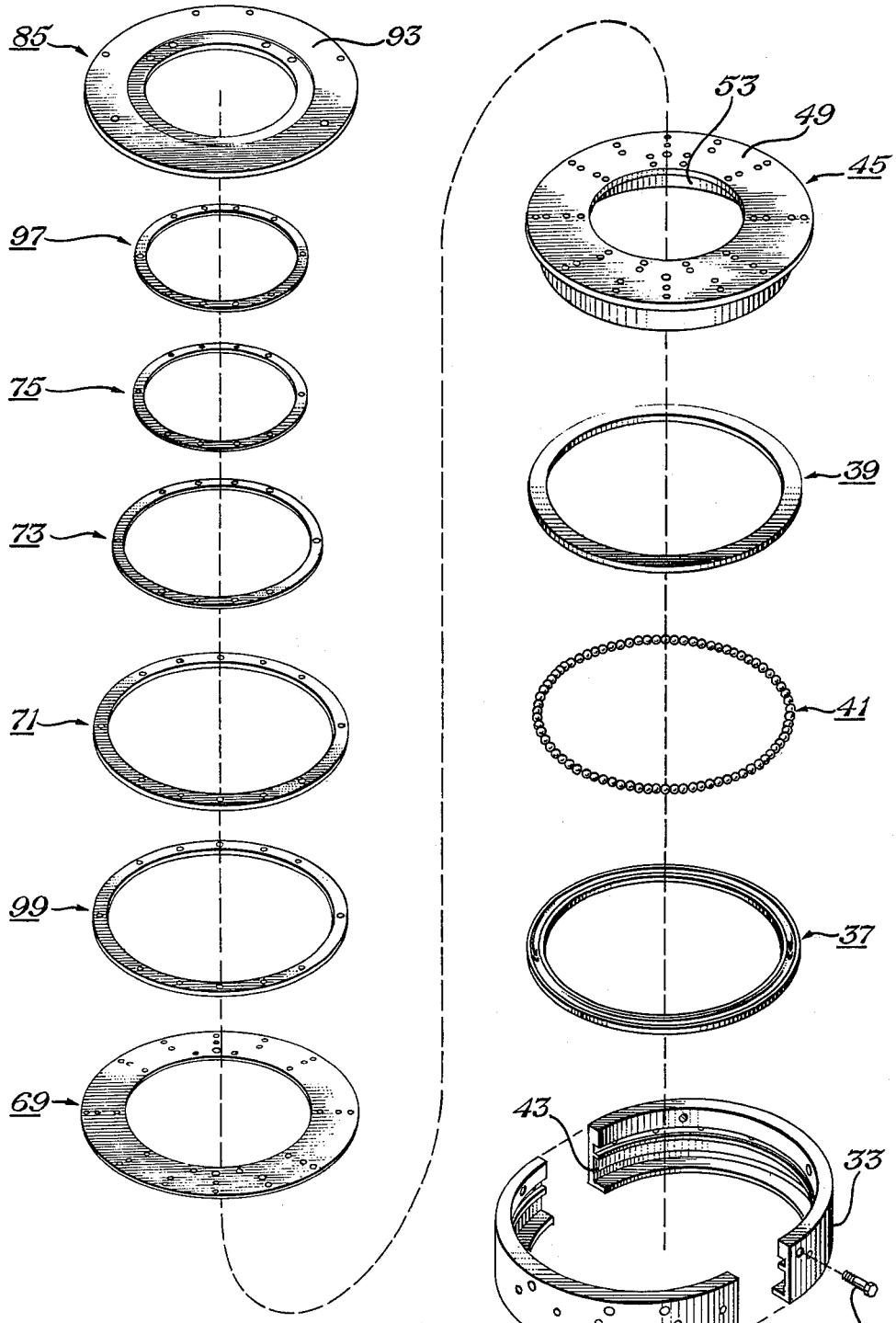
FIG. 3 is an exploded perspective view of the bearing support ring and parts contained therein.

Expansive means comprising an annular expansive bladder 69 made of an elastomeric material is mounted on the top transverse surface 49 of stationary seal ring 45 (FIGS. 3 and 4). The elastomeric material which is preferred for bladder 69 is the copolymer of 1, 3 butadiene and acrlonitrile known as buna-N rubber. Buna-N rubber is preferred due to its excellent oil and heat resistance. Bladder 69 is die cut from a flat sheet approximately $\frac{1}{8}''$ thick. The outer edge of bladder 69 is secured to the top transverse surface 49 of seal ring 45 by means of an outer retainer ring 71 (FIG.'s 3, 4). Outer retainer ring 71 is bolted or otherwise secured to top transverse surface 49 so as to seal off the outer edge of bladder 69. Similarly, middle retainer ring 73 and inner retainer ring 75 are attached in concentrically spaced apart fashion to top surface 49 to seal off the inner edge of bladder 69 and form annular expansive regions 77, 79 shown in FIG. 4. Expansive regions 77, 79 have perforations 81, 83 (FIG. 11) to allow fluid flow.

An annular air transfer plate 85 is provided with a peripheral flange 87 which is secured in a slot 89 on the bearing support ring 33 as by bolts 91, see FIG.'s 3, 4, 8, 9, 10, and 11. Air transfer plate 85 is mounted generally coaxially with respect to housing 13 and, as shown in FIG.'s 8, 9, and 10, is generally ring shaped with upper and lower surfaces 93, 95 respectively which are generally transverse to the axis of the pipe opening in the rotary table 15. Surfaces 93, 95 are preferably perpendicular to said pipe opening axis. Referring now to FIG.'s 4, 9, and 10, the lower surface 95 of air transfer plate 85 is adjacent to but rides above the top surface 49 of seal ring 45 on inner bumper ring 97 and outer bumper ring 99. Outer bumper ring 99 is bolted to the top surface 49 of seal ring 45 as shown in FIG. 4 by bolts 72. Inner bumper ring 97 bolts to the inner retaining ring 75. As best seen in FIG.'s 9, and 10, air transfer plate 85 has inner and outer downwardly facing annular recesses 101, 103 respectively for confining expansive regions 77, 79 of annular expansive bladder 69. The expansive regions 77, 79 of bladder 69, perforations 81, 83, and downwardly facing recesses 101, 103 cooperate to form an annular expansive fluid duct when pressure is applied to primary fluid conduits 55, 57. Downwardly facing annular recesses 101, 103 have lower openings 105, 107 connected by means of air passages 109, 111 to upper openings 113, 115 shown in FIG.'s 9, 10 and 11. One end of passages 109, 111 is tapped with plugs 110, 112, respectively.

Figure 11:
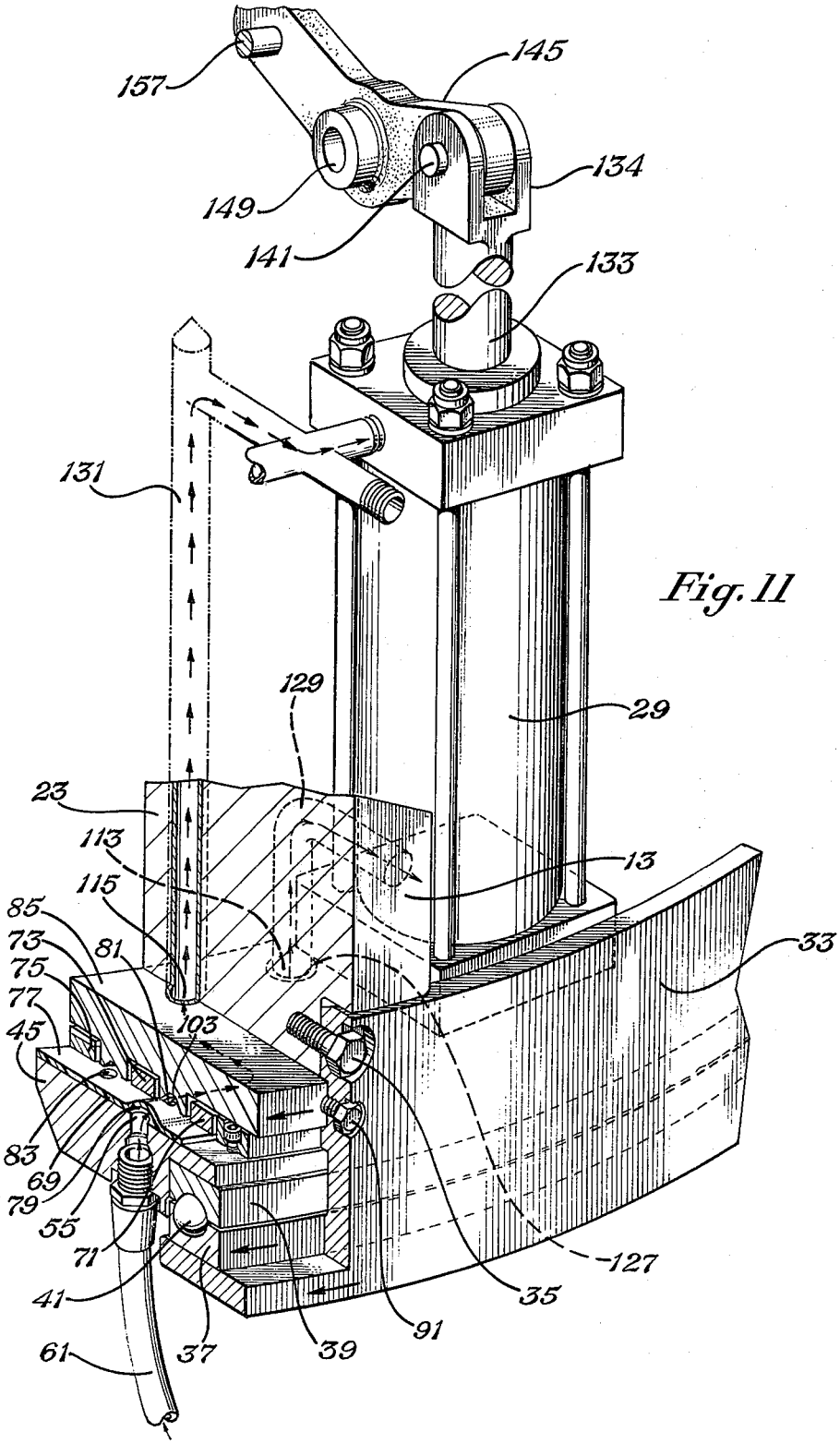
FIG. 11 is a fragmentary perspective view of a portion of the apparatus to better illustrate its operation.

Upper openings 113, 115 on air transfer plate 85 are arranged for communication with secondary fluid conduits 129, 131 in the lower end 23 of housing 13, (see FIG. 11). As seen in FIG.'s 9 and 10, grooves 121, 123 are cut around upper openings 113, 115 for receiving "o" rings thereby maintaining an air tight seal between air transfer plate 85 and housing 13.

Secondary fluid conduits 129, 131 shown in FIG. 11 are arranged to deliver fluid pressure from openings 113, 115 to opposed ends of a respective fluid cylinder, in this case 29.

Figure 12:
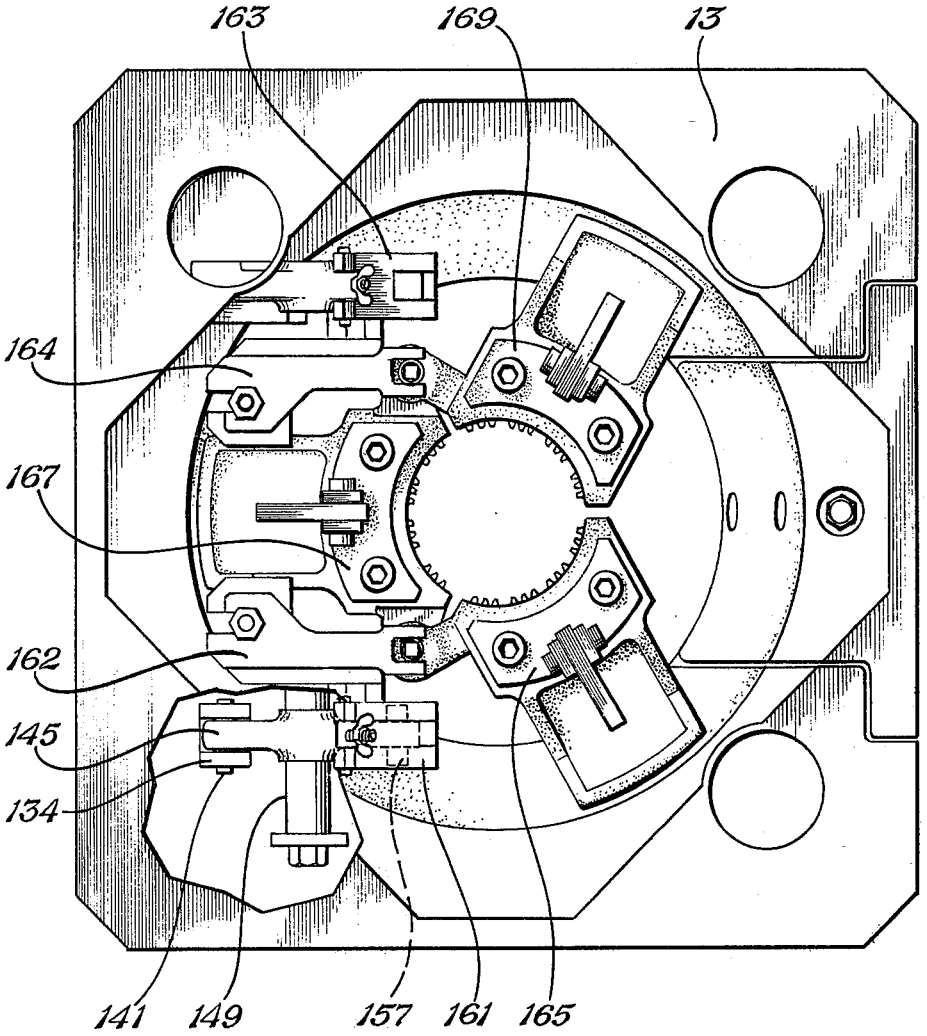
FIG. 12 is a top view of the rotary power slips.

Cylinders 29, 31 have output shafts 133, 135 which extend upwardly through vertical openings 137, 139 in housing 13, see FIG.'s 2 and 11. Shafts 133, 135 terminate in yokes 134, 136 which are connected by pins 141, 143 to one end of actuator arms 145, 147 which are pivotally supported in housing 13 by horizontally extending pins 149, 151. The opposite ends of actuator arms 145, 147 are provided with holes in which are mounted pins 157, 159 which are received by bosses 161, 163 attached to slips 165, 167, 169 (see FIG. 12) by hinge arrangements 162, 164. Slips 165, 167, 169 are mounted in housing 13 and are moveable between a retracted position to grip pipe when output shafts 133, 135 are extended as shown in FIG. 12 and an extended position to release pipe when output shafts 133, 135 ae retracted. Operation and design of slips 165, 167, and 169 are shown in greater detail in U.S. Pat. No. 3,999,260 to Stuckey et al, the disclosure of which is hereby incorporated by reference.

In operation, as best shown in FIG. 11, parts 39, 45, 69, 71, 73 and 75 are held stationary at all times by attached lines 61 and 63 and by a cable attached to eyebolt 67. Bearing friction and seal drag in the unit exert rotational forces on parts 39, 45, 69, 71, 73 and 75. Eyebolt 67 and its attached cable hold these parts stationary and lessen wear and tear on the attached lines 61 and 63. Parts 13, 33, 37, and 85 rotate in the direction of the arrows upon rotation of the rotary table 15. While drilling, slips 165, 167, 169 are normally in the extended pipe releasing position and parts 13, 33, 37 and 85 are rotating with the rotary table. When it is desired to run pipe in or out of the well bore, movement of rotary table 15 is stopped. Slips 165, 167, 169 can then be activated between gripping and releasing positions.

First assume housing 13 is stationary and the slips are in the pipe gripping position. Pressure is supplied to the primary fluid conduit 55 from a stationary source 59 on the drilling rig as shown schematically in FIG. 5. Flow passes from source 59 through cut-off valve 171 down line 172 through filter 173, regulator 175, and lubricator 177 to safety valve 179. Here the flow is divided with part of the flow passing out line 180 to other parts of the rig. Flow continues down line 181 to foot control pedal 65. Pedal 65 is located at the driller's console on the drilling rig floor and controls flow out lines 61, 63 by up and down action of the pedal.

Figure 9:
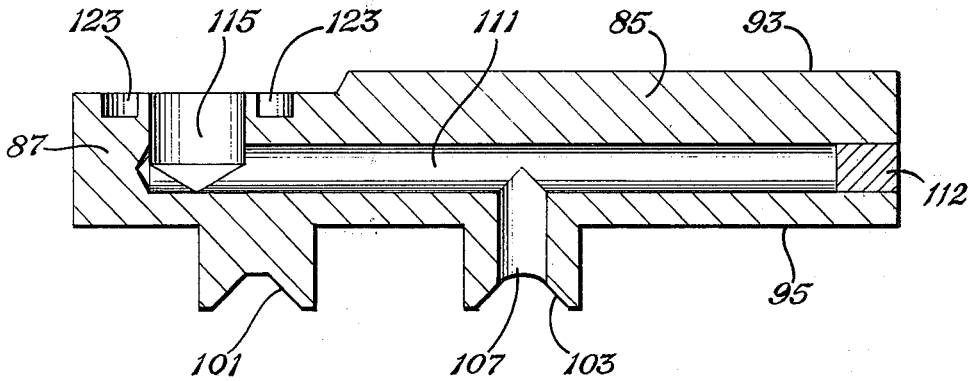
FIG. 9 is a sectional view taken generally along lines IX—IX of FIG. 8.
Figure 10:
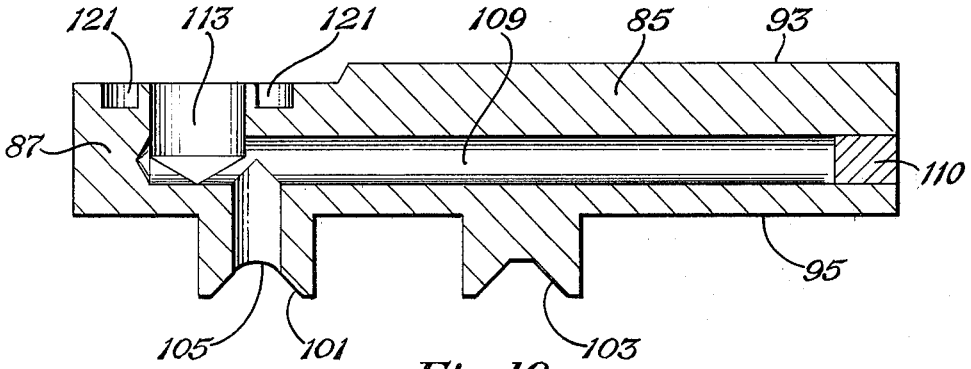
FIG. 10 is a sectional view taken generally along lines X—X of FIG. 8.

Pressure passes through line 61 with the pedal in the position shown and travels through a regulator 182 to the primary fluid conduit 55 of stationary seal ring 45. As seen in FIG. 11, expansive region 79 of bladder 69 sealed off by outer and middle retaining rings 71, 73 is expanded in the direction of air transfer plate 85. Downwardly facing annular recess 103 confines expansion of the bladder 69 and forms an air tight seal therewith. Pressure flows along the annular duct formed by the upper transverse surface 49 of seal ring 45 and the now expanded bladder 69 until it reaches perforation 81. Pressure then flows out perforation 81 and along the annular duct formed by the expanded bladder 69 and downwardly facing annular recess 103. When pressure reaches lower opening 107 in air transfer plate 85 (see FIG. 9), flow is directed through passage 111 and out upper opening 115. Upper opening 115 communicates with one end of fluid cylinder 29 as shown in FIG. 11 by means of secondary fluid conduit 131. Pressure is secondary conduit 131 causes cylinder shaft 133 to be retracted which acts in turn through actuator arm 145 and hinge arrangement 162 to extend the slips to the pipe releasing position.

Drill pipe can now be run in or out of the well bore. When it is desired to once again grip the drill pipe, foot pedal 65 is moved to the position opposite that shown in FIG. 5. In the opposite manner from that previously described, pressure is applied to the opposite end of fluid cylinder 29 causing shaft 133 to extend, thereby closing the slips on the drill pipe.

It should be apparent from the foregoing that an invention having significant advantages has been provided. The stationary seal ring 45 is carried by bearing support ring 33, which is attached to the lower end 23 of housing 13. By having the stationary seal ring 45 in physical connection at all times with housing 13, the need for a special mounting structure underneath the rotary table is eliminated.

The transfer of air between adjacent transverse surfaces 49 and 95 results in a structure of shorter overall length which occupies less space in the rotary table and which gives quicker response to the slips.

Having stationary seal ring 45 in physical connection with housing 13 eliminates the problem of misalignment of expansive regions 77, 79 with downwardly facing annular recesses 101, 103. The result is a longer wearing expansive seal which is more effectively sealed against the accumulation of mud and debris.

While the invention has been shown in only one of its forms, it should be apparent to those skilled in the art that it is not thus limited but is susceptible to various changes and modifications without departing from the spirit thereof.

I claim:

1. Improved rotary power slips having a housing for mounting concentrically with the pipe opening in a rotary table of an earth drilling rig, comprising:

an annular stationary seal ring supported by the housing with a transverse upper surface and an annular opening generally coaxial with the pipe opening in the rotary table, said stationary seal ring having a primary fluid conduit for connection to a stationary fluid source on the drilling rig;

an annular air transfer plate secured to the housing with a transverse lower surface adjacent the stationary seal ring;

expansive means mounted on the upper surface of said stationary seal ring and cooperative with the lower transverse surface of said air transfer plate for forming at least one annular expansive fluid duct therewith when pressure is applied to said primary fluid conduit in said stationary seal ring;

said housing having a secondary fluid conduit in fluid communication with said annular fluid duct;

fluid actuated operator means connected to said slips and carried by said housing in fluid connection with said secondary fluid conduit to selectively grip and release pipe in the rotary table in response to fluid flow through the primary conduit, the annular expansive fluid duct, the air transfer plate, and the secondary fluid conduit.

2. Improved rotary power slips having a housing for mounting concentrically with the pipe opening in a rotary table of an earth drilling rig, comprising:

an annular bearing support ring secured to the lower end of said housing for rotation therewith;

a bearing carried by the bearing support ring;

a stationary seal ring supported by the bearing with an annular opening generally coaxial with the pipe opening in the rotary table, said stationary seal ring having a primary fluid conduit for connection to a stationary fluid source and valve means on the drilling rig;

an air transfer plate secured to the bearing support ring generally coaxially within the housing and having an air passage therethrough;

an annular expansive bladder mounted on an upper transverse surface of said stationary seal ring and cooperative with a lower surface of said air transfer plate for forming at least one annular expansive fluid duct therewith when pressure is applied to said primary fluid conduit in said stationary seal ring;

said housing having a secondary fluid conduit for fluid connection to said passageway in said air transfer plate;

said slips being mounted in the housing and movable between an extended position to release pipe and a retracted position to grip pipe;

fluid actuated operator means being connected to the slips and carried by said housing in fluid connection with said secondary fluid conduit, the air transfer plate, the expansive fluid duct, and the primary fluid conduit for movement of the slips between said extended and retracted positions.

3. Improved rotary power slips operable from a fluid source and valve means and having a housing for mounting concentrically with the pipe opening in a rotary table of an earth drilling rig, comprising:

an annular bearing support ring secured to the lower end of said housing for rotation therewith;

a bearing carried by the bearing support ring;

a stationary seal ring supported by the bearing with an annular opening generally coaxial with the pipe opening in the rotary table, said stationary seal ring having a primary fluid conduit for connection to the stationary fluid source and valve means on the drilling rig;

an annular expansive bladder mounted on an upper transverse surface of the stationary seal ring and having perforation means for the flow of fluid;

an air transfer plate secured to the bearing support ring and mounted generally coaxially within the housing, said air transfer plate having a lower transverse surface with an annular recess therein to confine said bladder expansion and form a fluid duct with the upper transverse surface of the stationary seal ring through said perforation means;

said housing having a secondary fluid conduit in fluid connection with said fluid duct when said bladder is expanded;

said slips being mounted in the housing and movable between an extended position to release pipe and a retracted position to grip pipe;

fluid actuated operator means carried by said housing and connected to said slips to selectively grip and release pipe in the rotary table in response to fluid flow through the primary conduit, the expansive annular fluid duct, the air transfer plate and the secondary fluid conduit.

4. Improved rotary power slips operable from a fluid source and valve means and having a housing for mounting concentrically with the pipe opening in a rotary table of an earth drilling rig, comprising:

an annular bearing support ring secured to the lower end of said housing for rotation therewith;

a bearing carried by the bearing support ring;

a stationary seal ring supported by the bearing with an annular opening generally coaxial with the pipe opening in the rotary table, said stationary seal ring having a primary fluid conduit for connection to the stationary fluid source and valve means on the drilling rig;

an annular expansive bladder mounted on an upper transverse surface of the stationary seal ring and having perforations therein for the flow of fluid;

an air transfer plate secured to the bearing support ring and mounted generally coaxially within the housing, said air transfer plate having a lower transverse surface with inner and outer downwardly facing annular recesses therein to confine said bladder expansion thereby forming inner and outer fluid ducts with the upper transverse surfaces of the stationary seal ring for the flow of fluid through said perforations;

said slips being mounted in the housing and movable between an extended position to release pipe and a retracted position to grip pipe;

a double acting pneumatic cylinder carried by said housing and connected to said slips, said cylinder being in fluid communication at one end to said inner fluid duct and at the opposite end to said outer fluid duct for movement of the slips between said extended and retracted positions in response to fluid flow through said perforations.

* * * * *